US009630308B2

(12) United States Patent
Nickels et al.

(10) Patent No.: US 9,630,308 B2
(45) Date of Patent: Apr. 25, 2017

(54) DEMOLITION HAMMER WITH REVERSIBLE HOUSING AND INTERCHANGEABLE WEAR PLATE ARRANGEMENT

(71) Applicant: Caterpillar Inc., Peoria, IL (US)

(72) Inventors: James G. Nickels, McGregor, TX (US); Lauritz Phillip Pillers, McGregor, TX (US); Tommie Lee Craven, Belton, TX (US)

(73) Assignee: Caterpillar Inc., Peoria, IL (US)

( * ) Notice: Subject to any disclaimer, the term of this patent is extended or adjusted under 35 U.S.C. 154(b) by 505 days.

(21) Appl. No.: 14/166,809

(22) Filed: Jan. 28, 2014

(65) Prior Publication Data

US 2014/0144659 A1 May 29, 2014

Related U.S. Application Data

(62) Division of application No. 12/967,122, filed on Dec. 14, 2010, now Pat. No. 8,672,052.

(51) Int. Cl.
*B25D 17/24* (2006.01)
*E02F 3/96* (2006.01)
(Continued)

(52) U.S. Cl.
CPC ..... *B25D 17/24* (2013.01); *B25D 17/00* (2013.01); *B25D 17/28* (2013.01); *E02F 3/966* (2013.01);
(Continued)

(58) Field of Classification Search
CPC . E02F 3/966; E02F 3/964; E02F 3/962; E02F 3/96; E02F 3/404; E02F 5/305;
(Continued)

(56) References Cited

U.S. PATENT DOCUMENTS 3,944,300 A * 3/1976 Learmont ..... E21B 19/24 173/164
4,861,112 A 8/1989 Grant
(Continued)

FOREIGN PATENT DOCUMENTS

EP 0884140 12/1998
JP 10001966 1/1998
(Continued)

OTHER PUBLICATIONS

Case Construction Demolition Attachments, Brochure, Sep. 16, 2009, 18 pages.
(Continued)

*Primary Examiner* — Scott A. Smith
(74) *Attorney, Agent, or Firm* — Finnegan, Henderson, Farabow, Garrett & Dunner LLP

(57) ABSTRACT

A demolition hammer is provided that includes a housing that is reversible and a plurality of interchangeable wear plates. The demolition hammer may include a housing a housing having a first wall and a second wall opposite the first wall, and a power cell disposed within the housing, the power cell having a front face, wherein the housing is reversible such that the housing can be used with the power cell in a first orientation in which the front face faces the first wall and a second orientation in which the front face faces the second wall.

20 Claims, 8 Drawing Sheets

(51) Int. Cl.
*B25D 17/28* (2006.01)
*E02F 5/30* (2006.01)
*B25D 17/00* (2006.01)

(52) U.S. Cl.
CPC ..... *E02F 5/305* (2013.01); *Y10T 29/49721* (2015.01)

(58) Field of Classification Search
CPC ..... B25D 17/00; B25D 17/08; B25D 17/24; B25D 17/28
USPC ..... 173/90, 91, 128, 133, 162.1, 206, 211; 299/37.4, 70; 37/403
See application file for complete search history.

(56) References Cited

U.S. PATENT DOCUMENTS 5,285,858 A 2/1994 Okada et al.
5,363,835 A 11/1994 Robson
5,647,440 A * 7/1997 Barry ..... A01B 73/065 111/57
6,095,257 A 8/2000 Lee
6,227,307 B1 5/2001 Lee
6,430,849 B1 * 8/2002 Underwood ..... E02F 3/964 37/403
6,751,896 B2 * 6/2004 Underwood ..... E02F 3/964 37/403
7,257,910 B2 * 8/2007 Underwood ..... E02F 3/425 37/403
7,628,222 B2 12/2009 Yoshimura et al.
8,061,439 B2 * 11/2011 Nelson ..... B28D 1/26 173/128
8,146,677 B2 4/2012 Kim
8,672,052 B2 * 3/2014 Nickels ..... E02F 3/966 173/128
8,708,061 B2 * 4/2014 Nickels ..... B25D 17/24 173/128
9,089,995 B2 * 7/2015 Nelson ..... B28D 1/26
9,127,442 B1 * 9/2015 Underwood ..... E02F 3/964
2002/0162251 A1 * 11/2002 Underwood ..... E02F 3/964 37/403
2008/0173457 A1 * 7/2008 Kahra ..... B25D 17/08 173/90

FOREIGN PATENT DOCUMENTS

WO WO 9802283 1/1998
WO WO 03100176 12/2003
WO WO 2006046816 5/2006

OTHER PUBLICATIONS

Caterpillar, "Hydraulic Hammers—H45 through H180 s", Dec. 31, 2004, XP002671826, Retrieved from the Internet: URL: http: borusanmakinacom/BorusanMakina/Machines/pdf/Caterpillar %20Kiricilar.pdf [retrieved on Dec. 3, 2016].

* cited by examiner

DEMOLITION HAMMER WITH REVERSIBLE HOUSING AND INTERCHANGEABLE WEAR PLATE ARRANGEMENT

This is a divisional of application Ser. No. 12/967,122, filed Dec. 14, 2010 and entitled "DEMOLITION HAMMER WITH REVERSIBLE HOUSING AND INTERCHANGEABLE WEAR PLATE ARRANGEMENT," now U.S. Pat. No. 8,672,052, the entire disclosure of which is incorporated herein by reference.

TECHNICAL FIELD

This disclosure relates generally to demolition hammers, and more specifically to a demolition hammer with a reversible housing and interchangeable wear plate arrangement.

BACKGROUND

Demolition hammers are used on work sites to break up hard objects such as rocks, concrete, asphalt, frozen ground, or other materials. The hammers may be mounted to machines, such as back hoes and excavators, or may be hand-held. Such hammers may include a pneumatically or hydraulically actuated power cell having an impact system operatively coupled to a tool that extends from the hammer to engage the hard object.

The power cell of a demolition hammer may be positioned within a housing and supported on buffers, which allow some relative movement between the power cell and the housing. A plurality of wear plates may be interposed between the power cell and the interior of the housing. For example, a hammer with a square housing may have four separate wear plates (front, back, right side, and left side) that surround a portion of the power cell.

In operation, demolition hammers are in close proximity to a variety of objects that may dent or otherwise damage the hammer housing. Furthermore, the movement of the power cell relative to the housing during operation results in wear of the wear plates. Thus, the housing and the wear plates may need periodic replacement.

Wear on the wear plates and damage to the housing, however, may not be uniform. For example, front and rear wear plates may wear more than side wear plates and the rear of the housing may be exposed to, and damaged by, hard objects more than the front of the housing. Current hammers housings, however, can be used in only one orientation and current wear plates are not able to be used, interchangeably, on all sides, thus limiting replacement options when wear occurs.

SUMMARY OF THE DISCLOSURE

According to certain aspects of this disclosure, a demolition hammer may include a reversible housing and an interchangeable wear plate arrangement. The demolition hammer a housing having a first wall and a second wall opposite the first wall, and a power cell disposed within the housing, the power cell having a front face, wherein the housing is reversible such that the housing can be used with the power cell in a first orientation in which the front face faces the first wall and a second orientation in which the front face faces the second wall.

In another aspect of the disclosure, a wear plate for a demolition hammer may include a plate-like body having a first face, a second face generally parallel to the first face, and angled side edges adjacent the first face, the body defining a first pair of apertures positioned equidistant from a central longitudinal axis, each aperture configured to receive a first pin along a first axis and a second pin along a second axis, different than the first axis.

In a further aspect of the disclosure, a method for servicing a demolition hammer having a housing with a first wall opposite a second wall, a power cell disposed inside the housing and facing the first wall, and wear plates interposed between the power cell and the housing, wherein the wear plates include a front wear plate, a back wear plate, and two side wear plates, may include removing the power cell from the housing, switching positions of the side wear plates with the front and back wear plates and reinstalling the power cell into the housing such that the power cell faces the second wall.

DETAILED DESCRIPTION

Figure 1:
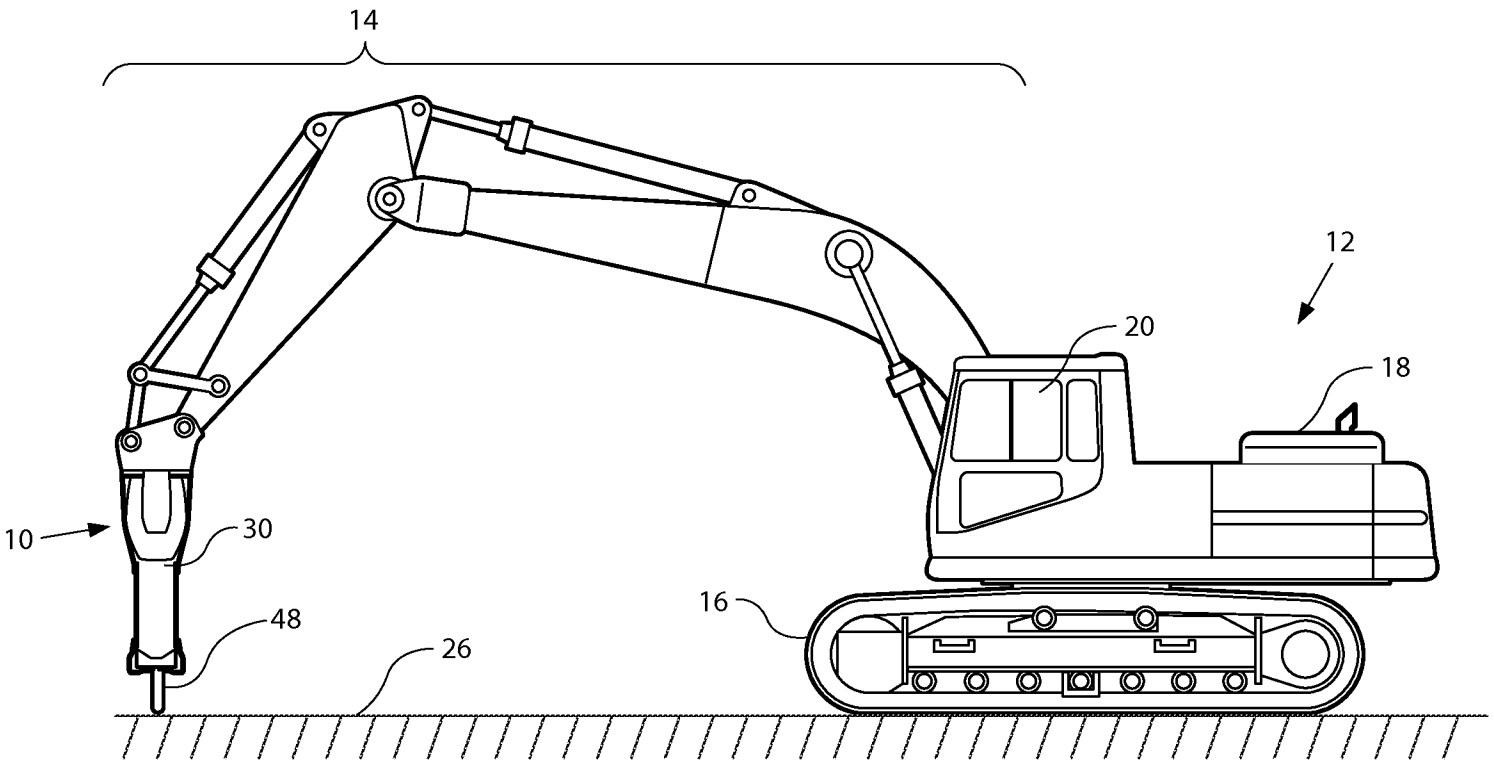
FIG. 1 is a diagrammatic illustration of a machine having a demolition hammer.

Referring to FIG. 1, a demolition hammer 10 is attached to a machine 12. Machine 12 may embody a fixed or mobile machine that performs some type of operation associated with an industry such as mining, construction, farming, transportation, or any other industry known in the art. For example, machine 12 may be an earth moving machine such as a backhoe, an excavator, a dozer, a loader, a motor grader, or any other earth moving machine. Machine 12 may include an implement system 14 configured to move the demolition hammer 10, a drive system 16 for propelling the machine 12, a power source 18 that provides power to implement system 14 and drive system 16, and an operator station 20 for operator control of implement system 14 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic pneumatic power for moving the implement system 14.

Implement system 14 may include a linkage structure acted on by fluid actuators to move the hammer 10. The linkage structure of implement system 14 may be complex, for example, including three or more degrees of freedom.

The implement system 14 may carry the hammer 10 for breaking an object or ground surface 26.

The structure and operation of a demolition hammer are briefly described below. Demolition hammers are known in the art, and since it will be apparent to one skilled in the art that various aspects of the disclosed the housing and wear plates may be used with a variety of demolition hammers, a detailed description of all the components and operation of a demolition hammer is not provided.

Figure 2:
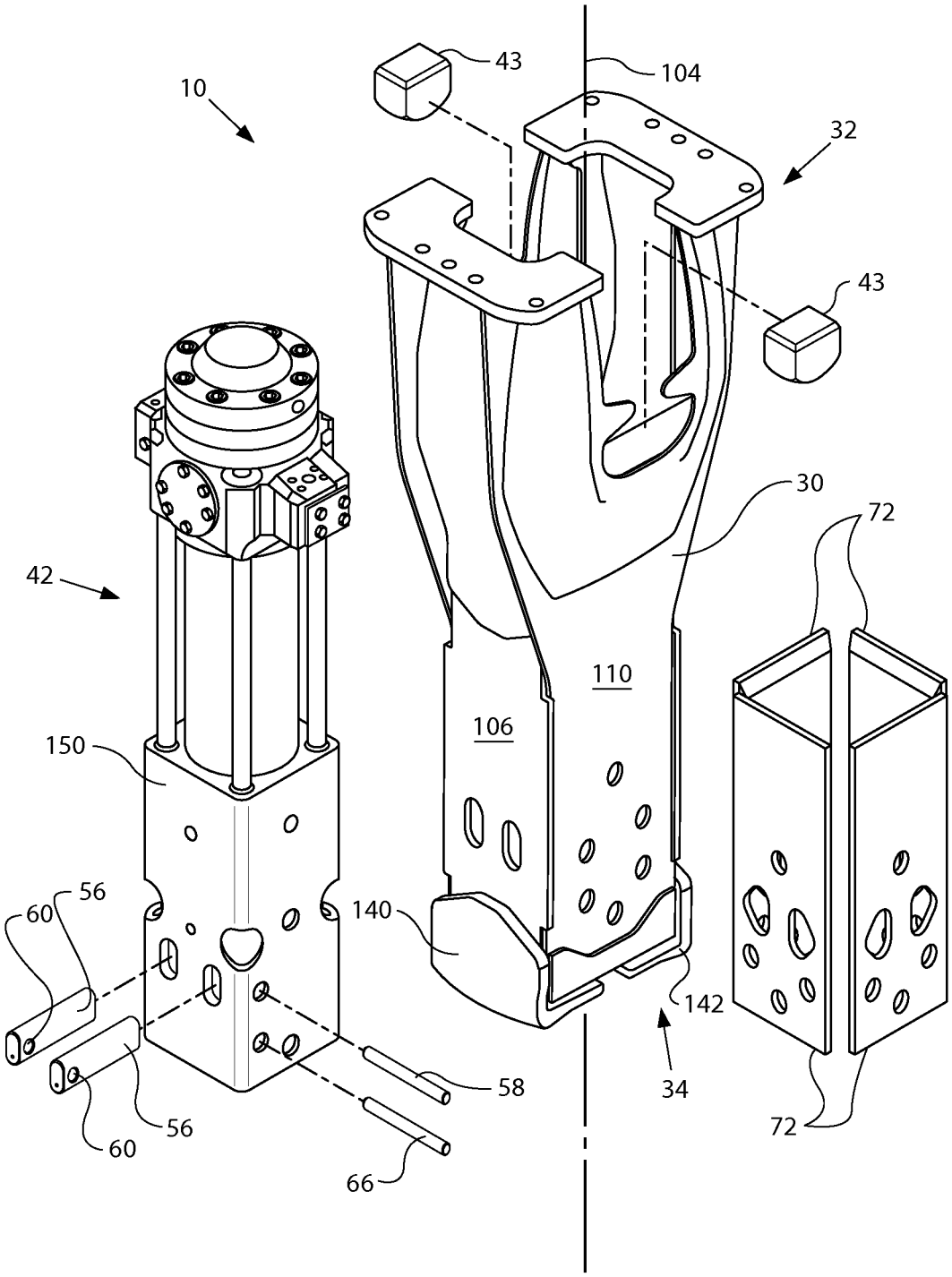
FIG. 2 is a partial exploded view of an exemplary demolition hammer.
Figure 3:
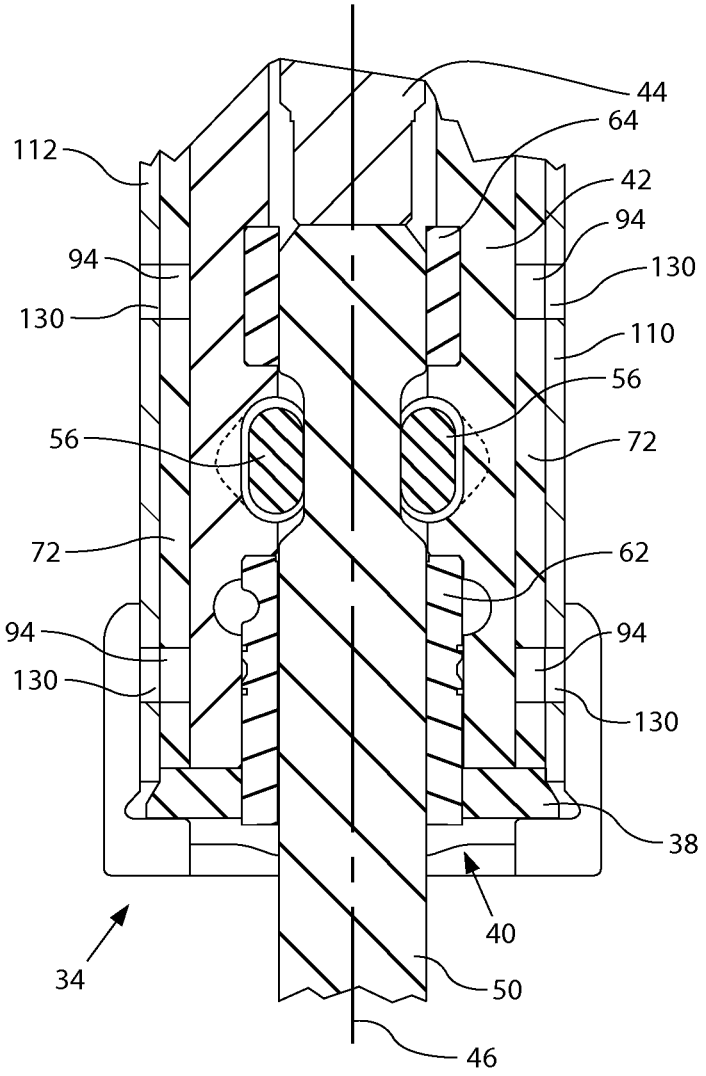
FIG. 3 is partial cross-sectional view of the distal end of the hammer of FIG. 2, cut along axis 12 (see FIG. 7).
Figure 4:
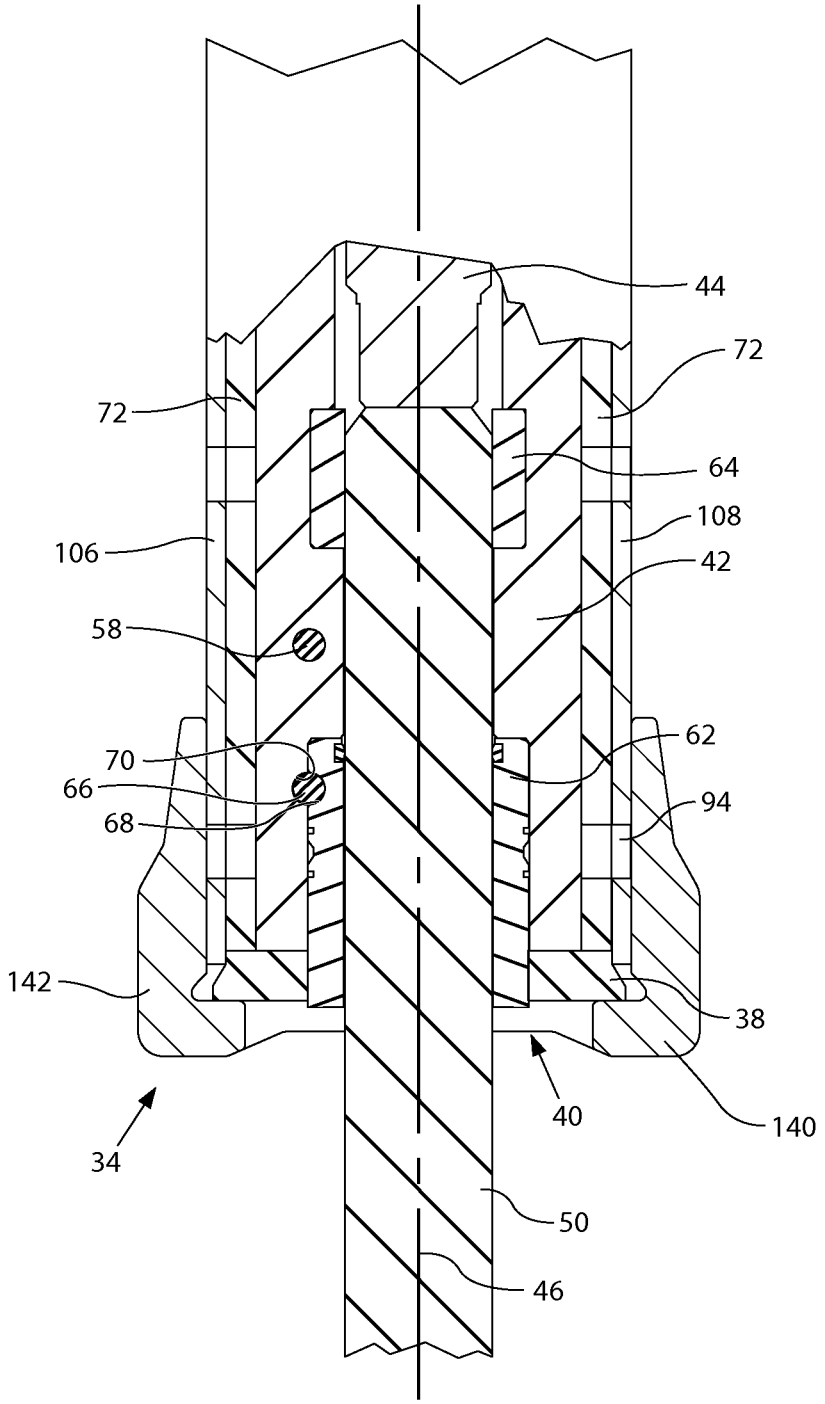
FIG. 4 is partial cross-sectional view of the distal end of the hammer of FIG. 2, cut along axis 118 (see FIG. 8).

Referring to FIGS. 2-5, the hammer 10 includes a hollow housing 30 having a proximal end 32 and a distal end 34. An end plate 38, defining an opening 40, is attached to the distal end 34 of the housing 30. A power cell 42 is supported inside the housing 30 by one or more side buffers 43. The power cell 42 includes several internal components of the hammer 10. As shown in FIGS. 3-4, the power cell 42 provides an impact assembly that includes a piston 44. The piston 44 is operatively positioned within the power cell 42 to move along an axis 46. A distal portion of the power cell 42 includes a tool 50 that is operatively positioned to move along the axis 46.

In operation, near the end of the work stroke, the piston 44 strikes the tool 50. The distal end of the tool 50 may be positioned to engage an object or ground surface 26 (see FIG. 1). The impact of the piston 44 on the tool 50 may cause a shock wave that fractures the hard object (e.g. rock) causing it to break apart.

The hammer 10 may be powered by any suitable means, such as pneumatically-powered or hydraulically-powered. For example, a hydraulic or pneumatic circuit (not shown) may provide pressurized fluid to drive the piston 44 toward the tool 50 during a work stroke and to return the piston 44 during a return stroke. The hydraulic or pneumatic circuit is not described further, since it will be apparent to one skilled in the art that any suitable hydraulic or pneumatic systems may be used to provide pressurized fluid to the piston 44, such as the hydraulic arrangement described in U.S. Pat. No. 5,944,120.

The tool 50 is retained within the power cell 42 by a pair of first pins 56 (e.g. tool retaining pins). The first pins 56 allow the tool 50 to move axially, but provide limits to how far the tool may extend or retract. The first pins 56 may also absorb some of the impact load if the tool 50 does not contact a hard object or ground surface 26 during a power stroke. In the depicted embodiment, the first pins 56 have an oval cross-section with a height greater than a width, but in other embodiments, the first pins may be shaped differently. Though described as a pair, the two first pins may be configured differently from one another.

The first pins 56 are held in place by a second pin 58 (e.g. a tool pin retaining pin). The second pin 58 is received through an aperture 60 in each of the first pins 56. In the depicted embodiment, the second pin 58 has a circular cross-section that is smaller in height of the height of the first pins 56, but in other embodiments, the second pin may be shaped differently.

A lower bushing 62 and an upper bushing 64 are positioned in the power cell 42 for guiding the tool 50 during operation of the hammer 10. The lower bushing 62 is retained in the power cell 42 by a third pin 66 (e.g. bushing retaining pin). The lower bushing 52 includes a groove 68 that aligns with a corresponding groove 70 in the power cell 42 when the lower bushing is installed. The third pin 66 is received in the grooves 68, 70 to hold the lower bushing 62 in place. In the depicted embodiment, the third pin 66 has a circular cross-section that corresponds to the shape of the grooves 68, 70, but in other embodiments, the third pin and the grooves may be shaped differently.

A plurality of wear plates 72 are interposed between the power cell 42 and the housing 30. In the depicted embodiment, the hammer 10 includes four wear plates 72 (a front plate, a rear plate, a right side plate, and a left side plate), but in other embodiments, more or less than four wear plates may be used. The wear plates 72 are configured to be interchangeable with one another. For example, the wear plates 72 may include apertures configured to receive the first pins 56, the second pin 58, and the third pin 66. Thus, each wear plate can be used in different positions (e.g. front, back, or side) and still have appropriate apertures for the position. The wear plates 72 may, for example, be substantially identical to each other.

Figure 6:
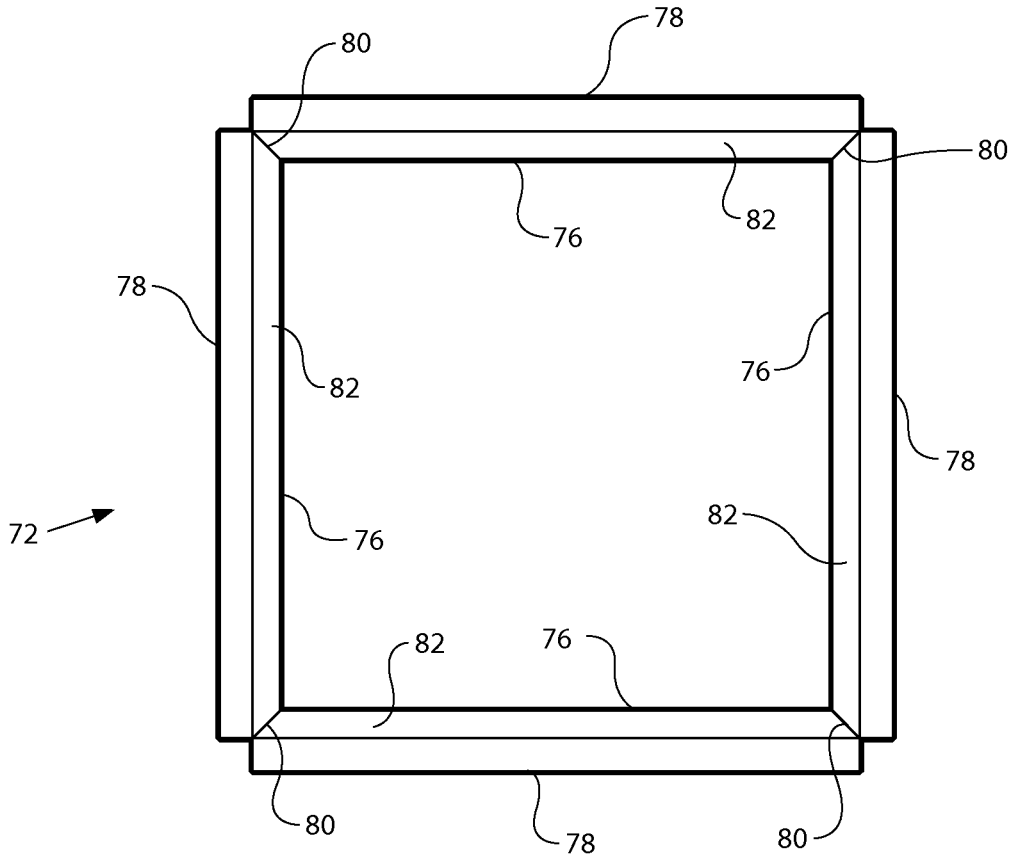
FIG. 6 is a top view of the wear plates of FIG. 5 oriented as they would be when installed in the hammer of FIG. 2.
Figure 7:
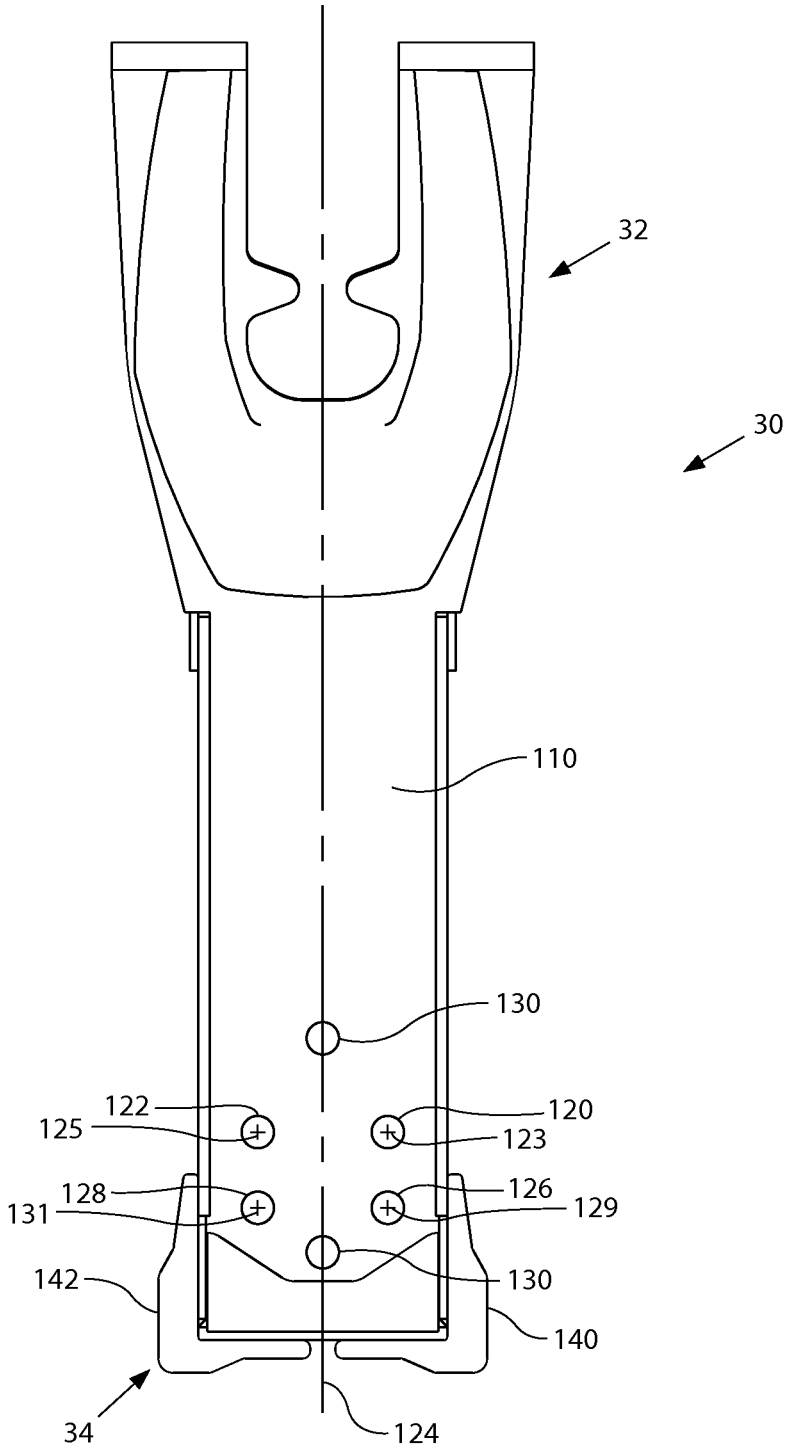
FIG. 7 is a front view of an exemplary housing of the hammer of FIG. 2.

The wear plate 72 may be configured in a variety of ways. Any wear plate that can be interposed between the power cell 42 and the housing 30 and be interchangeable with other wear plates may be used. Referring to FIGS. 6-7, the wear plate 72 includes a plate-like body 74 having a front face 76, a rear face 78 generally parallel to the front face 76, angled side edges 80 adjacent the front face 76, and an angled top edge 82 adjacent the front face 76.

The body 74 defines a plurality of apertures. In the depicted embodiment, the apertures are positioned generally symmetric about a central longitudinal axis 83. The body 74 defines a first aperture 84 and a second aperture 86. The first aperture 84 and the second aperture 86 are each configured to receive the third pin 66 and may be shaped in a variety of ways. In the depicted embodiment, the first aperture 84 and the second aperture 86 are circular and slightly larger than the diameter of the third pin 66. The first aperture 84 is centered on an axis 87 and the second aperture 86 is centered on an axis 89. The first aperture 84 and the second aperture 86 are positioned approximately equidistant and on opposite sides of the central longitudinal axis 83. In other embodiments, the wear plate 72 may have more than two apertures configured to receive the third pin 66.

Figure 5:
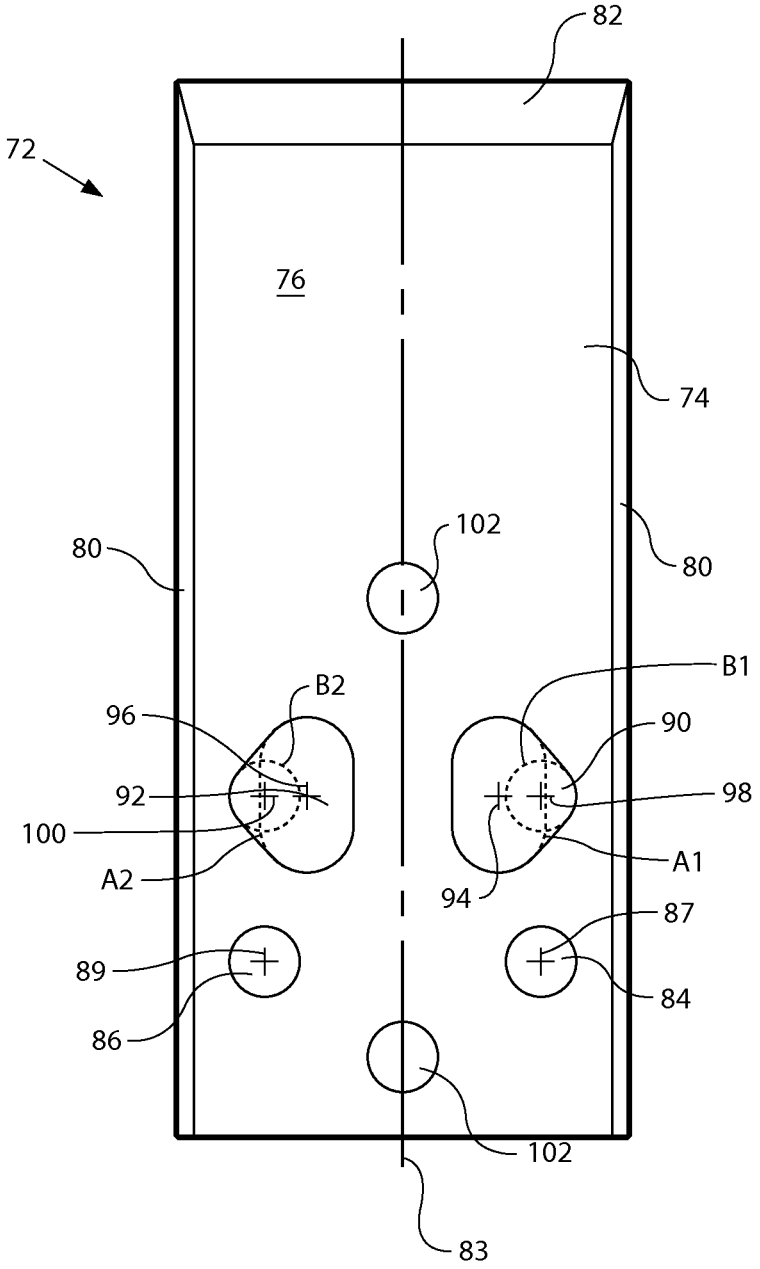
FIG. 5 is a front view of an exemplary wear plate of the hammer of FIG. 2.

The body 74 also defines a third aperture 90 and a fourth aperture 92. The third aperture 90 and the fourth aperture 92 may be shaped in a variety of ways. The third aperture 90 and the fourth aperture 92 are each configured to be able to receive both the first pin 56 and the second pin 58, non-concurrently. Referring to FIG. 5, the dashed line A1 illustrates that the oval first pin 56 may be received in the third aperture and the dashed line A2 illustrates that the oval first pin 56 may be received in the fourth aperture 92. Similarly, the dashed line B1 illustrates that the circular second pin 58 may be received in the third aperture 90 and the dashed line B2 illustrates that the circular second pin 58 may be received in the fourth aperture 92.

The dashed line A1 is centered on an axis 94, the dashed line A2 is centered on an axis 96, the dashed line B1 is centered on an axis 98, and the dashed line B2 is centered on an axis 100. The axis 94 and the axis 96 are positioned approximately equidistant and on opposite sides of a central longitudinal axis 83. Similarly, the axis 98 and the axis 100 are positioned approximately equidistant and on opposite sides of a central longitudinal axis 83. The axis 94 and the axis 96 are closer to the central longitudinal axis 83 than the axis 98 and the axis 100. In other embodiments, the wear plate 72 may have more than two apertures configured to receive both the first pin 56 and the second pin 58.

The body 74 also defines one or more grease port apertures 102 for providing access to grease conduits that supply lubrication to the upper bushing 64 and lower bushing 62. In the depicted embodiment, two grease port apertures 102 are positioned along the central longitudinal axis 83.

As illustrated in FIG. 6, the angled side edges 80 of the wear plates 72 are configured to engage corresponding angle side edges on adjacent wear plates. Thus, when installed in the hammer 10, the angled side edges 80 on the wear plates 72 engage each other to hold the wear plates in place. Therefore, if the power cell 42 is removed from the housing 30, the wear plates 72 hold each other in position.

Referring to FIGS. 2-4, the housing 30 may be formed as a single piece or multiple portions that are welded or otherwise joined together. The housing 30 is configured to be reversible. Thus, the housing 30 is configured to be used in both a first orientation and a second orientation that is rotated 180 degrees about a central longitudinal axis 104 from the first orientation. In the depicted embodiment, reversibility is accomplished by have apertures correctly positioned and configured for the first pins on the front and back of the housing and apertures correctly positioned and configured for the second and the third pin on the right and left side of the housing. The housing 30, however, may be configured in a variety of ways. Any shape and configuration that allows the housing to be reversible may be used.

Figure 8:
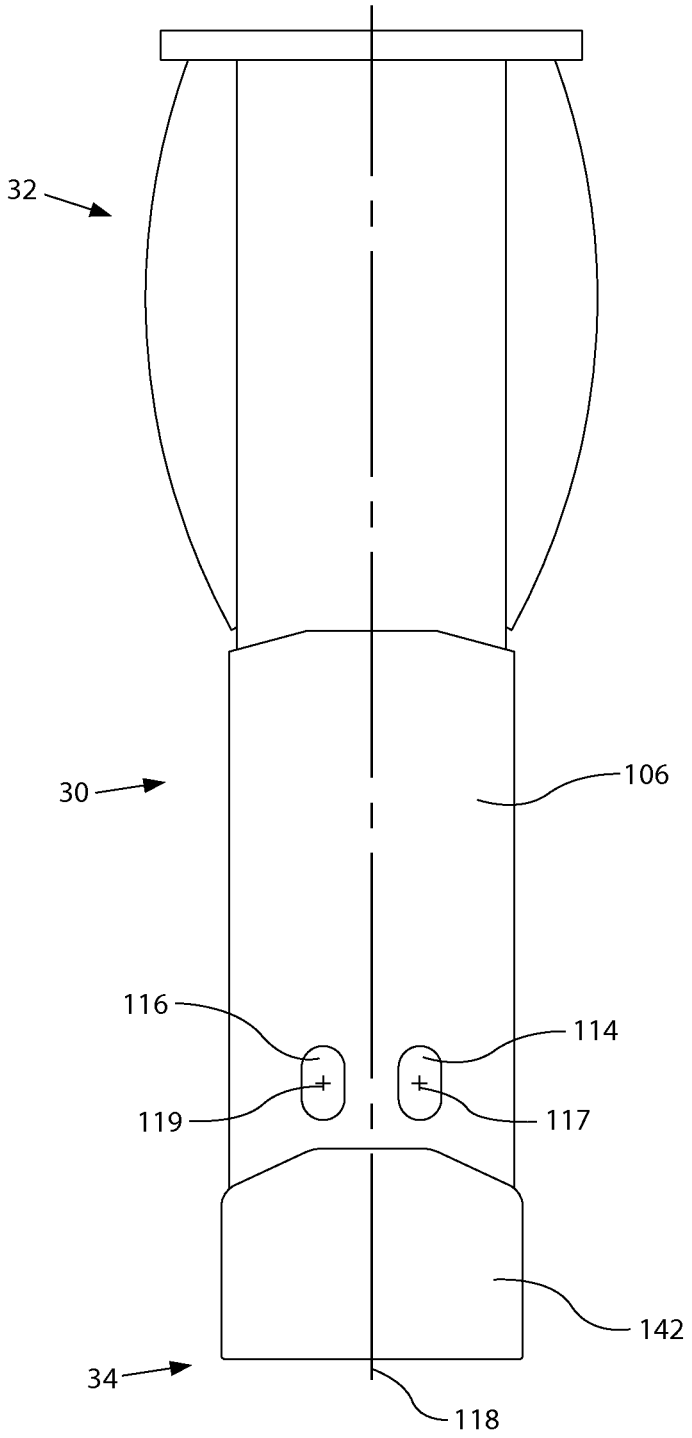
FIG. 8 is a side view of an exemplary housing of the hammer of FIG. 2.

In the depicted embodiment, the distal end 34 of the housing 30 includes four, substantially parallel, side walls. In particular, the housing 30 includes a first wall 106, a second wall 108 opposite the first wall, a third wall 110, and a fourth wall 112 opposite the third wall. Referring to FIG. 8, the first wall 106 includes a fifth aperture 114 and a sixth aperture 116. The fifth aperture 114 and a sixth aperture 116 are each configured to receive one of the first pins 56 and may be shaped in a variety of ways. In the depicted embodiment, the fifth aperture 114 and a sixth aperture 116 have an oval profile that corresponds to and is slightly larger than the oval cross-section of the first pin 56. The fifth aperture 114 is centered on axis 117 and the sixth aperture 116 is centered on axis 119. The axis 117 and the axis 119 are positioned approximately equidistant and on opposite sides of a central longitudinal axis 118. Thus, the first wall 106 is symmetric about axis 118. In other embodiments, however, the first wall 106 may not be symmetric and may have more than two apertures configured to receive one of the first pins 56. The first wall 106 is configured to be reversible with the second wall 108, thus the description of the first wall 106 is equally applicable to the second wall 108.

Referring to FIG. 7, the third wall 110 includes a seventh aperture 120 and an eighth aperture 122. The seventh aperture 120 and the eighth aperture 122 are each configured to receive the second pin 58 and may be shaped in a variety of ways. In the depicted embodiment, the seventh aperture 120 and the eighth aperture 122 are circular and slightly larger than the diameter of the second pin 58. The seventh aperture 120 is centered on axis 123 and the eighth aperture 122 is centered on axis 125. The axis 123 and the axis 125 are positioned approximately equidistant and on opposite sides of a central longitudinal axis 124. In other embodiments, the third wall 110 may have more than two apertures configured to receive the second pin 58.

The third wall 110 also includes a ninth aperture 126 and a tenth aperture 128. The ninth aperture 126 and the tenth aperture 128 are each configured to receive the third pin 66 and may be shaped in a variety of ways. In the depicted embodiment, the ninth aperture 126 and the tenth aperture 128 are circular and slightly larger than the diameter of the third pin 66. The ninth aperture 126 is centered on axis 129 and the tenth aperture 128 is centered on axis 131. The ninth aperture 126 and the tenth aperture 128 are positioned approximately equidistant and on opposite sides of a central longitudinal axis 124. In other embodiments, the third wall 110 may have more than two apertures configured to receive the third pin 66.

The third wall 110 also includes one or more grease port apertures 130 for providing access to grease conduits that supply lubrication to the upper bushing 64 and the lower bushing 62. In the depicted embodiment, two grease port apertures 130 are positioned along the central longitudinal axis 124. Thus, in the depicted embodiment, the third wall 110 is symmetric about axis 124. In other embodiments, however, the third wall 110 may not be symmetric. The third wall 110 is configured to be reversible with the fourth wall 112, thus the description of the third wall 110 is equally applicable to the fourth wall 112.

Referring to FIG. 2, the hammer 10 may also include a first rock claw 140 and a second rock claw 142. The distal end 34 of the hammer 10 may be used to manipulate hard objects, such as boulders, to better position the objects for breaking. The first rock claws 140 and the second rock claw 142 provide a surface to engage the hard objects and provide protection to the distal end 34 of the housing 30. The first and second rock claws 140, 142 may be configured in a variety of ways. Any configuration that can be used on both the front and back of a hammer, to facilitate reversibility of the hammer, and be used to engage and move hard objects while adequately protecting the distal end 34 of the housing 30 during use, may be used. The first and second rock claws 140, 142 may be separate components that are configured to be attached to the exterior surface of the housing 30 or may be integrally formed with the housing.

In the depicted embodiment, the first rock claw 140 and the second rock claw 142 are separate components attached on opposite sides of the housing 30 by any suitable means, such as welding. The first rock claw 140 and the second rock claw 142 each includes a portion that extends up the side of the housing to protect the housing side surface and also a portion that extends along the bottom of the housing to protect the bottom portion of the distal end 34 of the housing 30 and the end plate 38. A recess allows the rock claw to protect the distal end of the hammer without obstructing the tool 50 extending from the hammer.

When the hammer 10 is assembled, the power cell 42 is supported inside the housing 30 such that some relative movement may occur between the power cell 42 and housing 30 during operation. For reference purposes, the power cell 42 includes a front face 150 (FIG. 2) that faces the first wall 106 when the housing is in the first orientation or faces the second wall 108 when the housing is in the second orientation (i.e. rotated 180 degrees). The wear plates 72 are positioned between the power cell 42 and the housing walls. In the depicted embodiment, a wear plate 72 is positioned between the power cell 42 and each of the first wall 106, second wall 108, third wall 110, and fourth wall 112.

The first pins 56 are positioned in the power cell 42 to retain the tool 50 in the power cell. The wear plates 72 are positioned such that the apertures 90, 92 are aligned with the first pins 56 sufficiently to allow the first pins to be accessed through the apertures. Similarly, the housing 30 is positioned such that the apertures 114, 116 are aligned sufficiently with the first pins 56 and apertures 90, 92 in the wear plates 72 to allow the first pins 56 to be accessed through the apertures 114, 116. For example, the axis 94 on a first wear plate, the axis 96 on a second wear plate, the axis 117 on the first wall 106 of the housing 30 and the axis 119 on the second wall 108 of the housing 30 may be substantially aligned.

The second pin 58 is positioned to retain the first pins 56 in the power cell. The wear plates 72 are positioned such that one of the apertures 90, 92 is aligned with the second pin sufficiently to allow the second pin to be accessed through the apertures. Similarly, the housing 30 is positioned such that the one of the apertures 114, 116 is aligned sufficiently with the second pin 58 and apertures 90, 92 in the wear plates 72 to allow the second pin 58 to be accessed through the apertures 114, 116.

The third pin 66 is positioned to retain the lower bushing 62 in the power cell. The wear plates 72 are positioned such that one of the apertures 84, 86 is aligned with the third pin sufficiently to allow the third pin to be accessed through the apertures. Similarly, the housing 30 is positioned such that one of the apertures 126, 128 is aligned sufficiently with the third pin 66 and apertures 84, 86 in the wear plates 72 to allow the third pin 66 to be accessed through the apertures 126, 128.

INDUSTRIAL APPLICABILITY

During operation of the hammer, the tool and bushings may need to be replaced. This can be accomplished without removing the hammer from the machine. To remove the tool, the second pin and the first pins are removed through the corresponding apertures in the wear plates and housing, thus allowing the tool to be removed. To remove the lower bushing, the third pin is removed through the corresponding apertures in the wear plates and housing, thus allowing the lower bushing to be removed.

In operation, the hammer may be used in a manner that may dent or otherwise damage the hammer housing. Furthermore, during operation of the hammer, movement of the power cell relative to the housing may result in wear of the wear plates. Thus, the housing and the wear plates may need periodic replacement. Wear on the wear plates and damage to the housing, however, may not be uniform. For example, the rear of the housing 30 may receive more contact with potentially damaging hard objects than the front of the housing due to the manner of use of the hammer. In addition, wear on the wear plates adjacent the front and rear of the housing may receive more wear that the wear plates on the sides of the housing due to more front and back movement of the power cell within the housing.

The disclosed hammer includes interchangeable wear plates (e.g. the side wear plates may be switched with the front and back wear plates) to extend the life of a set of wear plates. In addition, the disclosed hammer is reversible. The housing can be rotated 180 degrees so that the front of the housing becomes the back and vice versa, thus extending the life of the housing. For example, if the front face of the power cell is facing the first wall of the housing, the hammer may be serviced by removing the power cell from the housing, switching positions of the side wear plates with the front and back wear plates, and reinstalling the power cell into the housing such that the front face of the power cell faces the second wall of the housing.

Furthermore, since the housing is reversible, the assembled hammer can be easily mounted on machines with left-hand pressure or right-hand pressure. For example, some machines may have hydraulic systems that supply working pressure on the right side, while other machines may have hydraulic systems that supply working pressure on the left side. For a non-reversible hammer, either the hoses have to be crossed to accommodate different machines, which tends to damage hoses more quickly during operation, or the hammer must be disassembled and the cylinder rotated 180 degrees from it's original position. The disclosed reversible hammer, however, can simply be mounted on a right-hand pressure machine in a first orientation and mounted on a left hand pressure machine in a second orientation, 180 degrees from the first, without needing to disassemble the hammer.

Although the disclosed embodiments have been described with reference to a hammer assembly in which the tool is driven by a hydraulically or pneumatically actuated piston, the disclosed embodiments are applicable to any tool assembly having a reciprocating work tool movable within a chamber by suitable drive structure and/or return structure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A demolition hammer, comprising:

a housing having a first wall and a second wall opposite the first wall, a power cell disposed within the housing, the power cell having a front face, wherein the housing is reversible such that the housing can be used with the power cell in a first orientation in which the front face faces the first wall and a second orientation in which the front face faces the second wall; and first and second wear plates, wherein the first and second wear plates are interchangeable and each of the first and second wear plates comprises a plate-like body having a first face, a second face generally parallel to the first face, the body defining a first pair of apertures positioned equidistant from a central longitudinal axis, each aperture configured to receive a first pin along a first axis and a second pin along a second axis, different than the first axis.

2. The demolition hammer of claim 1, wherein each of the first and second wear plates comprises angled side edges adjacent the first face.

3. The demolition hammer of claim 2, wherein the first axis is closer to the central longitudinal axis than the second axis.

4. The demolition hammer of claim 2, wherein the body is symmetric about the central longitudinal axis.

5. The demolition hammer of claim 2, wherein the body defines a second pair of apertures positioned equidistant from the central longitudinal axis, each aperture configured to receive a pin along a third axis, different than the first axis and the second axis.

6. The demolition hammer of claim 5, wherein the third axis is approximately the same distance from the central longitudinal axis as the second axis.

7. The demolition hammer of claim 5, wherein at least one of the first and second pairs of apertures is configured to receive pins of different shapes or sizes, nonconcurrently.

8. The demolition hammer of claim 1, wherein at least one of the first or second wear plates include an angled top edge.

9. The demolition hammer of claim 1, wherein at least one of the first or second wear plates include an angled side edge.

10. The demolition hammer of claim 1, further including third and fourth wear plates, wherein all of the first, second, third, and fourth wear plates are interchangeable.

11. A demolition hammer, comprising:

a housing having a first wall and a second wall opposite the first wall, a power cell disposed within the housing, the power cell having a front face, wherein the housing is reversible such that the housing can be used with the power cell in a first orientation in which the front face faces the first wall and a second orientation in which the front face faces the second wall;

a first wear plate interposed between the first wall and the power cell; and a second wear plate interposed between the second wall and the power cell, wherein each of the first and second wear plates comprises a plate-like body having a first face, a second face generally parallel to the first face, the body defining a first pair of apertures positioned equidistant from a central longitudinal axis, each aperture configured to receive a first pin along a first axis and a second pin along a second axis, different than the first axis.

12. The demolition hammer of claim 11, wherein each of the first and second wear plates comprises angled side edges adjacent the first face.

13. The demolition hammer of claim 12, wherein the first axis is closer to the central longitudinal axis than the second axis.

14. The demolition hammer of claim 12, wherein the body defines second pair of apertures positioned equidistant from the central longitudinal axis, each aperture configured to receive a pin along a third axis, different than the first axis and the second axis.

15. The demolition hammer of claim 14, wherein the third axis is approximately the same distance from the central longitudinal axis as the second axis.

16. The demolition hammer of claim 14, wherein at least one of the first and second pairs of apertures is configured to receive pins of different shapes or sizes, nonconcurrently.

17. The demolition hammer of claim 12, wherein the body is symmetric about the central longitudinal axis.

18. The demolition hammer of claim 11, wherein at least one of the first or second wear plates include an angled top edge.

19. The demolition hammer of claim 11, wherein at least one of the first or second wear plates include an angled side edge.

20. The demolition hammer of claim 11, further including third and fourth wear plates, wherein all of the first, second, third, and fourth wear plates are interchangeable.

* * * * *